US009108380B2

(12) United States Patent
Binger et al.

(10) Patent No.: US 9,108,380 B2
(45) Date of Patent: Aug. 18, 2015

(54) TRASH BAG WITH ODOR CONTROL AND METHOD OF MAKING SAME

(75) Inventors: Scott Binger, Bridgeview, IL (US); Carl L. Bergman, Loveland, OH (US); Jack A. MacPherson, Auora, IL (US); Howard Deason, Liberty Township, OH (US)

(73) Assignee: The Glad Products Company, Oakland, CA (US)

( * ) Notice: Subject to any disclaimer, the term of this patent is extended or adjusted under 35 U.S.C. 154(b) by 44 days.

(21) Appl. No.: 13/213,522

(22) Filed: Aug. 19, 2011

(65) Prior Publication Data

US 2013/0044966 A1 Feb. 21, 2013

(51) Int. Cl.

| | |
|---|---|
| ***B31B 1/64*** | (2006.01) |
| ***B65D 33/28*** | (2006.01) |
| ***B65F 1/00*** | (2006.01) |
| *B31B 19/64* | (2006.01) |

(52) U.S. Cl.

CPC . *B31B 1/64* (2013.01); *B65D 33/28* (2013.01); *B65F 1/002* (2013.01); *B65F 1/0026* (2013.01); *B31B 19/64* (2013.01); *B31B 2219/2681* (2013.01); *B31B 2219/62* (2013.01); *B31B 2219/88* (2013.01); *B31B 2219/9003* (2013.01); *B31B 2219/9096* (2013.01); *B31B 2237/10* (2013.01); *B31B 2237/406* (2013.01); *B65D 2203/12* (2013.01)

(58) Field of Classification Search

CPC ..... B65F 1/0006; B65F 1/002; B65F 1/0026; B65D 33/2525; B65D 33/2591; B65D 2203/12; B65D 33/28; B31B 37/00; B31B 1/64; B31B 2219/2681; B31B 2219/62; B31B 2219/88; B31B 2219/9003; B31B 2219/9096; B31B 2237/10; B31B 2237/406

USPC ..... 383/8, 37, 77, 105; 206/554; 493/189, 493/193–197, 220, 267

See application file for complete search history.

(56) References Cited

U.S. PATENT DOCUMENTS

| | | | | |
|---|---|---|---|---|
| 3,762,454 | A | 10/1973 | Wilkins, Jr. | |
| 4,273,549 | A * | 6/1981 | Pezzana et al. | 493/196 |
| 5,102,384 | A * | 4/1992 | Ross et al. | 493/243 |
| 5,845,769 | A | 12/1998 | Yeager | |
| 6,214,147 | B1 * | 4/2001 | Mortellite et al. | 156/201 |
| 6,416,452 | B1 * | 7/2002 | Meyer | 493/210 |
| 6,488,222 | B1 * | 12/2002 | West et al. | 242/160.4 |
| 7,328,789 | B2 | 2/2008 | Bohanan, Jr. et al. | |
| 7,497,623 | B2 | 3/2009 | Thomas et al. | |
| 8,157,444 | B2 * | 4/2012 | Broering et al. | 383/75 |
| 2003/0078552 | A1 | 4/2003 | Tepper et al. | |
| 2006/0110080 | A1 | 5/2006 | Thomas et al. | |
| 2006/0165319 | A1 * | 7/2006 | Patridge et al. | 383/107 |
| 2006/0286356 | A1 | 12/2006 | Thomas et al. | |
| 2006/0291756 | A1 | 12/2006 | Thomas et al. | |

(Continued)

*Primary Examiner* — Jes F Pascua
*Assistant Examiner* — Peter Helvey
(74) *Attorney, Agent, or Firm* — Thomas C. Feix

(57) ABSTRACT

The trash bag for receiving refuse may include a bag body, the bag body including an inside surface, an outside surface, and a rim defining a mouth with a hem and a draw tape in the hem. A liquid additive may be applied to the interior of the bag using the intermittent application of micro-droplets to the interior of a folded web and then converting to a roll of connected trash bags or to individual trash bags on a roll. The liquid additive may contain fragrance, malodor control agents and fragrance release inhibitors. Also, described is a method of producing trash bags with liquid additives applied by the application of micro-droplets.

20 Claims, 8 Drawing Sheets

(56) References Cited

U.S. PATENT DOCUMENTS

| | | | | |
|---|---|---|---|---|
| 2007/0189643 | A1 | 8/2007 | Tresenfeld | |
| 2008/0212903 | A1 * | 9/2008 | Germanow et al. | 383/42 |
| 2009/0026098 | A1 * | 1/2009 | Tierney | 206/315.11 |
| 2009/0045095 | A1 | 2/2009 | Wagner et al. | |
| 2009/0067760 | A1 | 3/2009 | Shelley et al. | |
| 2009/0175564 | A1 * | 7/2009 | Broering et al. | 383/75 |
| 2009/0196535 | A1 * | 8/2009 | Dorsey et al. | 383/74 |
| 2010/0108775 | A1 * | 5/2010 | Donaty | 239/4 |
| 2011/0164834 | A1 * | 7/2011 | Stiglic et al. | 383/75 |
| 2011/0245057 | A1 * | 10/2011 | Scoledes et al. | 493/227 |
| 2013/0188891 | A1 * | 7/2013 | Maxwell et al. | 383/75 |

* cited by examiner

TRASH BAG WITH ODOR CONTROL AND METHOD OF MAKING SAME

FIELD OF THE INVENTION

The present invention relates generally to trash bags, and particularly to trash bags with odor control features, and more particularly to draw tape trash bags with odor control features.

BACKGROUND OF THE INVENTION

Plastic trash bags have long been used to line trash receptacles. The trash bags encourage sanitary conditions by preventing the refuse from contacting the receptacle. Trash bags also provide a convenient way to remove trash from a receptacle for transport or disposal. Because trash often contains food scraps and other malodor producing items, attempts have been made to produce fragranced trash bags to hide the malodors produced by the bag contents. It is easy to apply volatile fragrance components directly to malodors in the air, for example with the active immediate use of a spray or aerosol air freshening composition. It is much more difficult to control malodors using passive diffusion from plastic trash bags. One of the difficulties is that many fragrance and malodor control agents are not soluble in the typical polyethylene composition of plastic trash bags. Another difficulty is that much of the fragrance and malodor control agents that can be volatilized at ambient temperatures to control malodor formed by trash are substantially volatilized during the trash bag production process, which involves high temperature melt extrusion of polyethylene or other plastics. This volatilization during the production process causes environmental issues within the manufacturing plant, wastes valuable volatile fragrance and odor control agents, and changes the notes of the fragrance and odor control agents as the components are differentially volatilized. These difficulties are particularly apparent in the production of draw tape trash bags, where the bags are large, the production process is complex, and the bags are used in an open configuration.

BRIEF SUMMARY OF THE INVENTION

In one embodiment, the bag may further comprise a front wall, a back wall, and a hem, the hem defining the rim. The hem may further define a passageway, which is at least partially enclosed. The hem may include a first opening and a second opening. The bag may comprise a draw tape, which is disposed within the passageway. The draw tape may be accessible via the first and second openings in the hem. The hem, the hem passageway, and the draw tape may comprise a hem area.

In another embodiment, the bag may comprise a bag body including a first portion. The first portion may include an upper rim, which defines a mouth. The bag may further comprise a second portion disposed below the first portion, the second portion defining a closed bottom to the bag.

In another embodiment, the bag may comprise a bag body, the bag body having an inside surface and an outside surface. The bag may comprise a rim, which defines a mouth. The bag may further comprise a hem that defines the rim. The hem area may define a passageway, the passageway being at least partially enclosed. The hem area may further include an inside surface, an outside surface, a first opening, and a second opening. The bag may also comprise a draw tape disposed within the passageway. The draw tape may be accessible via the first and second openings in the hem.

In another embodiment, the bag may comprise a bag body having an inside surface and an outside surface. The bag may comprise an undulating rim, the rim defining a mouth. The rim may include at least two flaps, wherein the flaps may be tied together to at least partially close the bag.

In addition to the foregoing, a method for applying fragrance components to a trash bag comprising the steps of providing a folded web having interior adjacent surfaces and exterior non-adjacent surfaces, opening the folded web and inserting one or more micro-droplet applicators between the interior adjacent surfaces of the web, using the one or more micro-droplet applicators to apply a fragrance component by an intermittent application of droplets using fluid pressure onto the interior surface of the folded web, closing the folded web, providing heat seals to the folded web, providing a separating means along the heat seals, and rolling the folded web into a roll In addition to the foregoing, a method for applying a liquid additive to a trash bag comprising the steps of providing a folded web having an interior surface and an exterior surface, opening the folded web and inserting one or more micro-droplet applicators adjacent to the interior surface of the web, using the one or more micro-droplet applicators to apply an intermittent application of droplets of a liquid additive onto the interior surface of the folded web, closing the folded web, providing heat seals to the folded web, providing a separating means along the heat seals, and separating the folded web along the separating means to form individual trash bags. In addition to the foregoing, a thermoplastic bag comprising a first sidewall of pliable thermoplastic material; a second sidewall of pliable thermoplastic material overlaying and joined to the first sidewall along a first side edge, an opposite second side edge, and a bottom edge extending between the first and second side edges to provide an interior volume, the interior volume accessible by an opening provided by first and second top edges of the respective first and second sidewalls, the first and second sidewalls having interior surfaces adjacent to the interior volume and exterior surfaces on the outside of the bag; a draw tape in a first hem formed proximate the first top edge, the draw tape attached to the bag at the first and second side edges, a second draw tape in a second hem formed proximate the second top edge, the second draw tape attached to the bag at the first and second side edges; wherein the first sidewall contains an intermittent application of micro-droplets of fragrance components adjacent to the interior volume.

Additional features and advantages of exemplary embodiments of the present invention will be set forth in the description which follows, and in part will be obvious from the description, or may be learned by the practice of such exemplary embodiments. The features and advantages of such embodiments may be realized and obtained by means of the instruments and combinations particularly pointed out in the appended claims. These and other features will become more fully apparent from the following description and appended claims, or may be learned by the practice of such exemplary embodiments as set forth hereinafter.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

BRIEF DESCRIPTION OF THE SEVERAL VIEWS OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The webs or films of the invention can be made by a conventional flat or tubular cast extrusion or coextrusion, or other suitable process such as a blown film process to produce monolayer, bilayer, trilayer or multilayer films. If desired for a given end use, these films can be oriented by tenterframe, or other suitable process. They can thereafter optionally be annealed. The films of the present invention are typically produced by the blown film or cast film process. The blown or cast film is formed by extrusion. For the blown film process, the film can be collapsed to double the plies of the film or the film can be cut and folded or cut and unfolded. The extruder is a conventional one using a die, which will provide the desired gauge. Some useful extruders are described in U.S. Pat. Nos. 4,814,135; 4,857,600; 5,076,988; 5,153,382; each of which are incorporated herein by reference. The gauge of the films of interest here can be in the range of about 0.1 to about 10 mils, suitably from about 0.2 to about 4 mils, and suitably in the range of about 0.3 to about 2 mils. Examples of various extruders, which can be used in producing the film of the present invention, are the single screw type modified with a blown film die and air ring and continuous take off equipment.

The film materials may be any thermoplastic material, typically LLDPE (linear low density polyethylene), and the film compositions may differ slightly according to their use or where there is a multilayer film, the film layers may differ from each other. For example, the film layers may have different strength or barrier properties, or properties designed for better sealing.

A draw tape bag includes of two layers of plastic film which are sealed on three sides and open on the remaining side to form an opening in the bag. A hem securing the draw tape is provided at the periphery of the open end whereby the tape is accessed through openings in the hem. By pulling the draw tape, the opening in the bag closes. Consequently, the draw tape serves as a handle whereby the bag may be grasped to be subsequently transported. The hem in a draw tape bag is formed by two layers of film which are fused together to create a hem seal. The hem seal is typically created by heating the film until it melts and then fusing the two layers together. Heat sealing operations typically create a strong bond which cannot be separated without destroying the film, otherwise known as a destructive bond. Draw tape bags and methods for making draw tape bags are described in U.S. Pat. Nos. 4,867,735, 4,966,059, and 5,006,380 which are incorporated herein by reference. In one embodiment, the draw tape may include a single layer. In one embodiment, the draw tape may include a first exterior layer, a second exterior layer, and at least one core layer disposed between the exterior layers as described in U.S. Pat. App. 2010/0172602 to O'Donnell et al.

Figure 1:
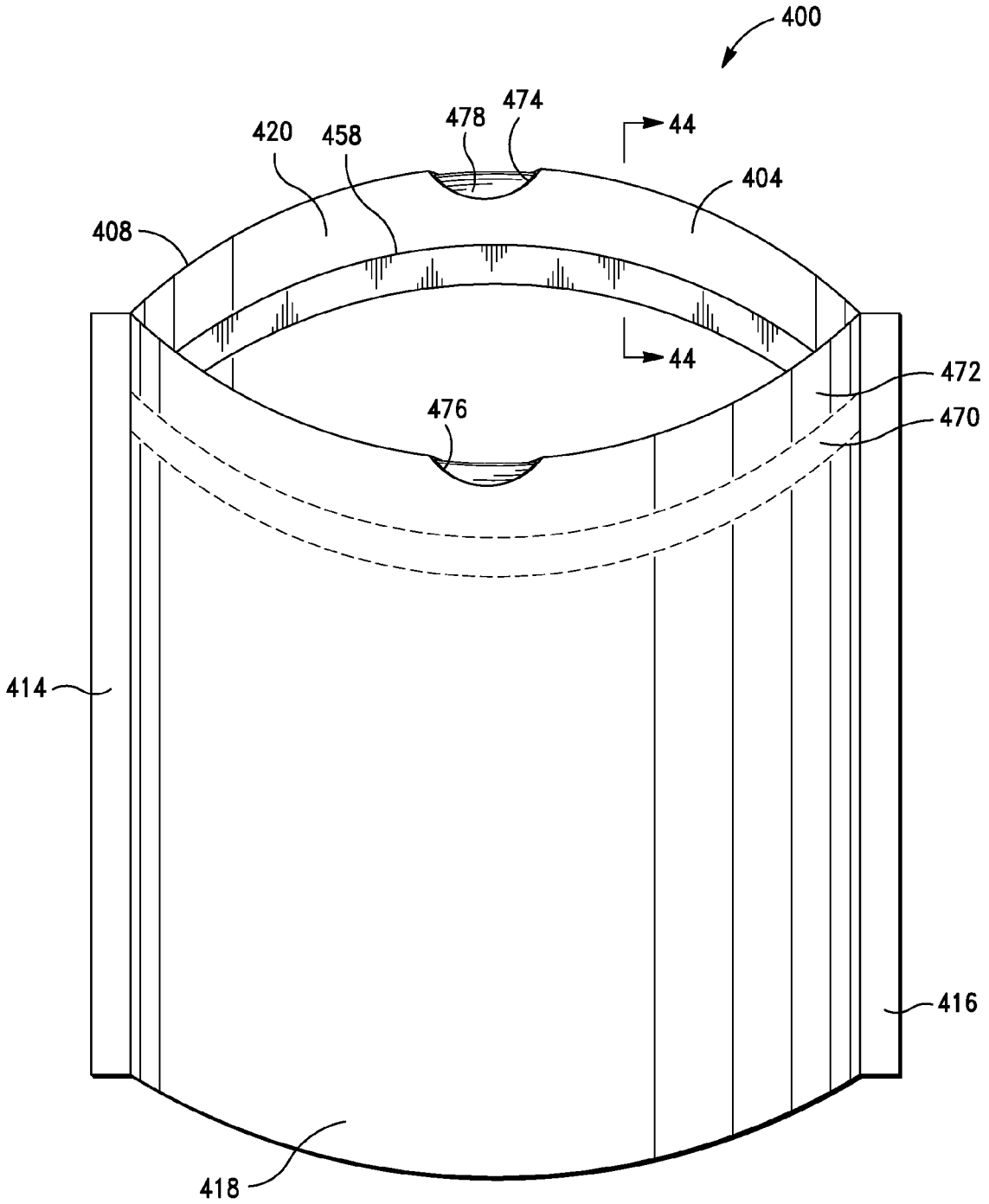
FIG. 1 is a perspective view of a draw tape bag of the invention.
Figure 2:
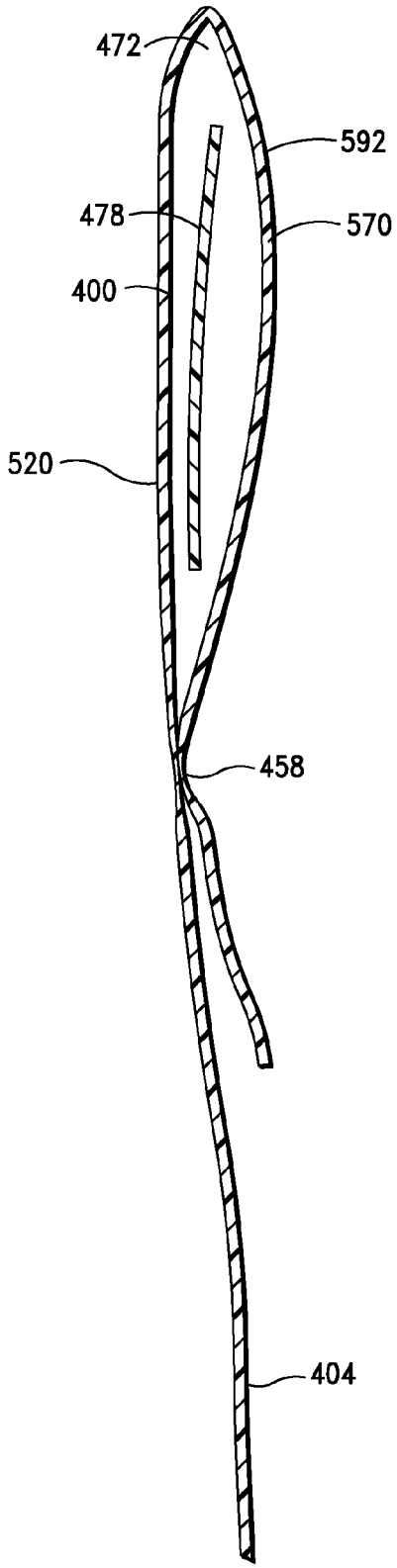
FIG. 2 is a cross sectional view taken along line 44-44 of the bag of FIG. 1.
Figure 3:
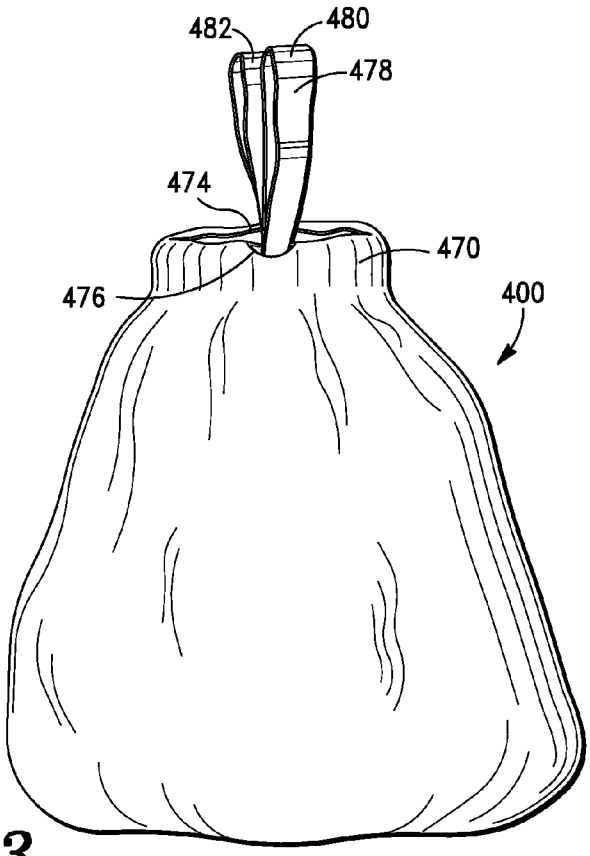
FIG. 3 is a perspective view of the bag of FIG. 1 wherein the draw tapes have been drawn to close the bag.

Referring to FIGS. 1 and 3, the bag 400 may include a left side seam 414 and a right side seam 416. The front wall 418 and the back wall 420 may be joined at both the left and right seams 414, 416. The bag 400 may include a hem 470 and the hem may define the rim 408. The hem 470 may further define a passageway 472, which is at least partially enclosed, as show in FIG. 2. Referring to FIG. 2, the hem 570 may be formed by folding an upper portion 592 of the back wall 520 of the bag 400 onto the inside surface 404 of the bag 400, and sealing it thereto at the hem seal 458. Alternately, the hem may be formed by sealing to the outside surface of the bag (not shown). The draw tape 478 is disposed within the passageway 472 thus created. The hem 470, the hem passageway 472, and the draw tape 478 may comprise a hem area. Referring to FIG. 1, the hem 470 may include a first opening 474 and a second opening 476. The bag 400 may comprise a draw tape 478, which is disposed within the passageway 472. The draw tape 478 may be accessible via the first and second openings 474, 476 in the hem 470. Referring to FIG. 3, the draw tape 478 allows a user to at least partially close the bag 400 by pulling on the two loops 480, 482 of the draw tape 478. In this configuration, any liquid additive, fragrance, malodor control agent, fragrance release inhibitor, or a combination thereof concentrated in the hem area, the draw tape, the interior of the bag, or the bottom of the bag is localized near the source of malodors.

Figure 4:
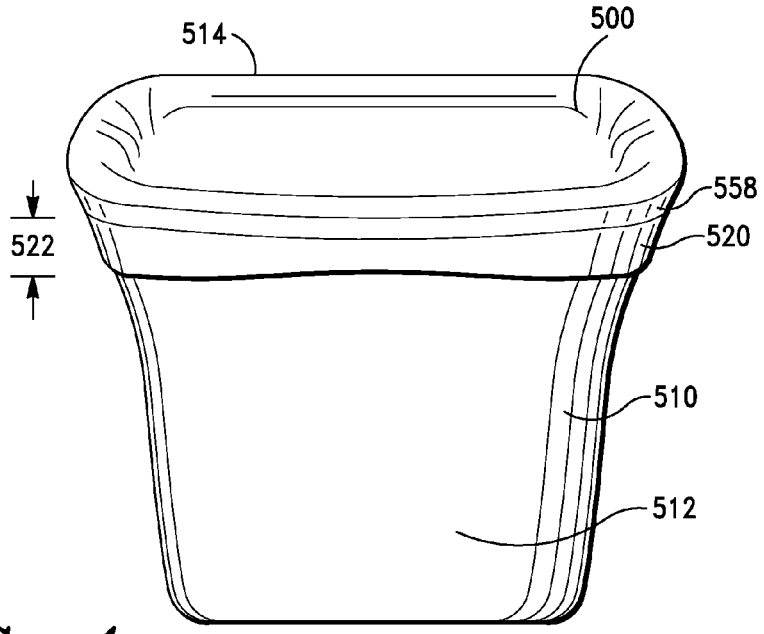
FIG. 4 is a perspective view of the bag of FIG. 1 inserted into a trash receptacle.

Referring to FIG. 4, the bag 500 may be arranged inside a trash receptacle 510. As the upper portions of the bag 500 are folded over the rim 514 of the trash receptacle 510, the hem 520 and hem seal 558 may become exposed on the outside 512 of the receptacle 510. Accordingly, the hem 520 will be visible outside the receptacle 510, possibly even when a lid is placed over the receptacle. The width 522 of the hem may correspond to a predetermined amount of the bag 500 to be folded over the rim of the trash receptacle 510 when the bag 500 is being arranged in the receptacle 510. A user of the bag 500 may be instructed to this correlation in order to achieve optimal use of the bag 500. Optimal use of the bag may be when a sufficient amount of bag 500 is folded over the rim 514 of the receptacle 510 such that it will not slip back inside the receptacle 510, but yet with sufficient bag remaining inside the receptacle to utilize the full trash receiving volume of the receptacle 510. With the hem 520 at the opening of the trash receptacle 510, the hem 520 is situated between the malodors generated inside the bag and the user environment. In this configuration, any fragrance or malodor control agent concentrated in the hem area, the draw tape, or the top of the bag is localized near the escape of malodors even if the trash receptacle 510 is covered.

Figure 5:
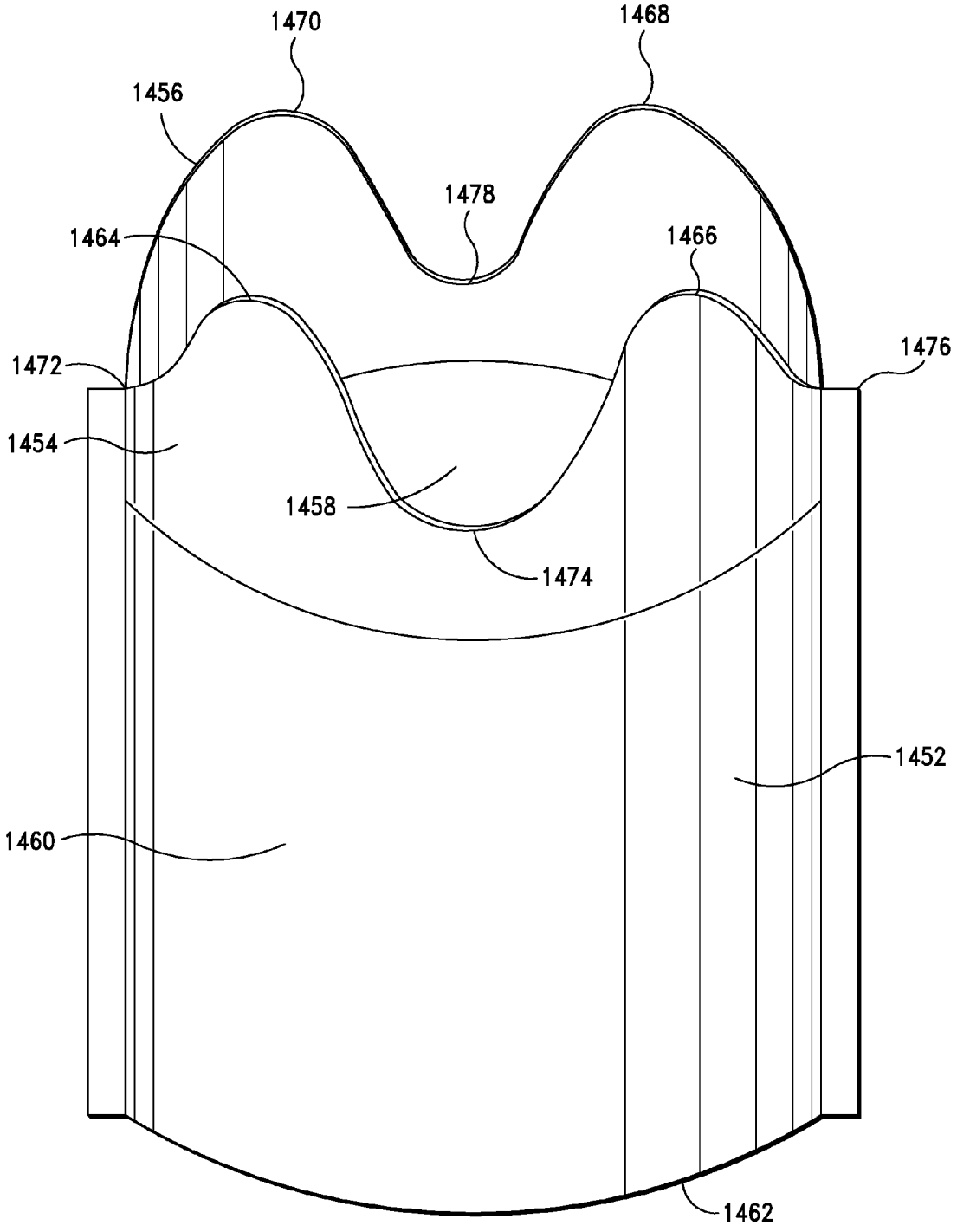
FIG. 5 is a perspective view of a bag of the invention.

Referring to FIG. 5, there is shown another embodiment. The bag 1450 for receiving refuse comprises a bag body 1452, the bag body 1452 including a first portion 1454. The first portion 1454 includes an upper rim 1456, which defines a mouth 1458. The bag body 1452 further includes a second portion 1460 disposed below the first portion 1454. The second portion 1460 defines a closed bottom 1462 to the bag 1450. The bag body 1452 may be thicker in the first portion 1454 than in the second portion 1460. The rim 1456 of the first portion 1454 may be an undulating rim. The rim 1456 may include four flaps 1464, 1466, 1468, and 1470. The four flaps 1464, 1466, 1488, and 1470 may be separated by four valleys 1472, 1474, 1476, and 1478. The flaps 1464, 1466, 1468, and 1470 may be tied together to at least partially close the bag 1450. In other embodiments, the bag may have two, three, five, six, seven, or eight flaps. In suitable embodiments, the flaps or the first portion may have different properties than other portions of the bag such as containing liquid additive, a fragrance, a malodor control agent, a fragrance release inhibitor, or a combination thereof The film may include a fragrance release inhibitor in the same layer as the fragrance and malodor control agents. A typical fragrance release inhibitor is titanium dioxide. Additional fragrance release inhibitors include starch, clays and nanoclays, talc, and microcapsules.

Figure 6:
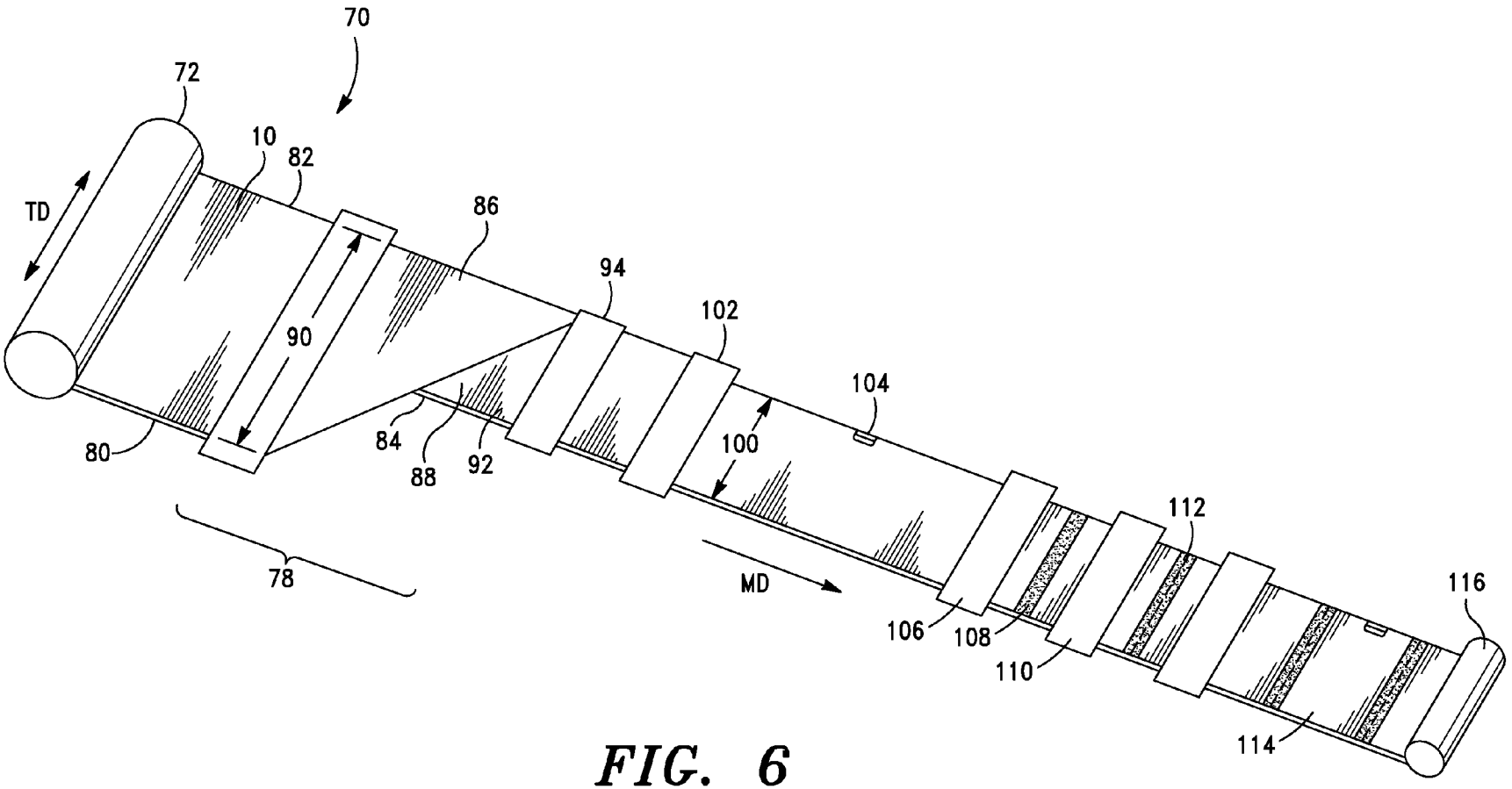
FIG. 6 is a process for producing bags of the invention.
Figure 7:
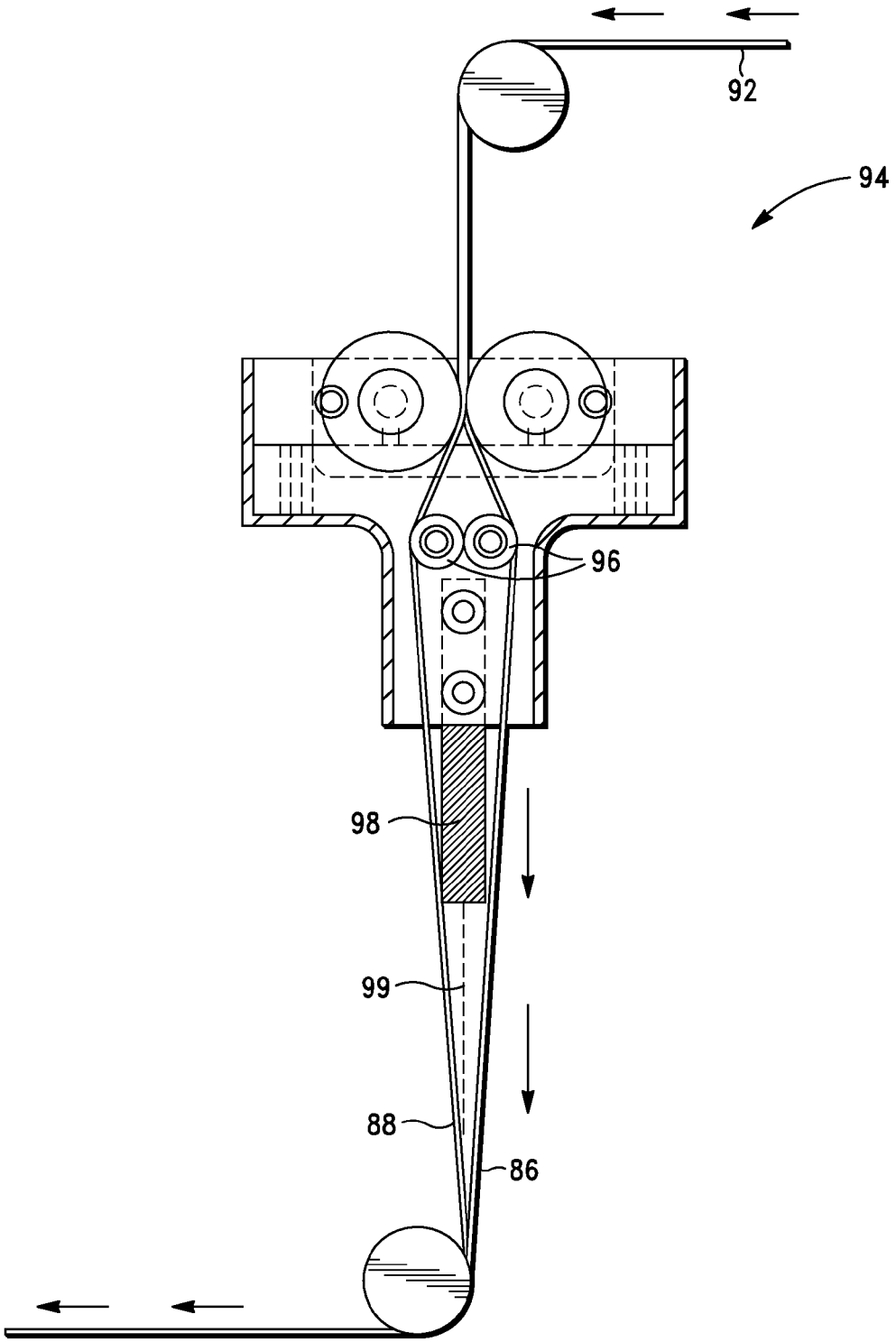
FIG. 7 is a process for producing bags of the invention.

Bags may be produced in a high speed, automated manufacturing process such as the one illustrated in FIGS. 6 and 7. The illustrated manufacturing process 70 includes automated equipment that may convert continuous sheet-like webs and thin film strips of planar thermoplastic material into the finished bags. For example, a web 10 of thermoplastic material may initially be provided on a roll 72 that may be unwound and movingly directed along a machine direction MD by the processing equipment. When unwound, the web 10 may have a first side edge 80 and a second side edge 82 that define a width 90 that is perpendicular to the machine direction MD.

To provide the interior volume of the finished bag, the web 10 may be folded in half orthogonally about the machine direction MD by a folding operation 78 so that the web is arranged as first and second opposing, adjacent webs halves 86, 88 being advanced in parallel along the machine direction MD. When folded in half, the first and second side edges 80, 82 are moved adjacent to each other. The width 100 of the folded web 92 may be half of the width 90 of the unfolded web. Moreover, once folded, the center of the web 10 provides a crease 84 that may correspond to the bottom edge of the finished bag. In another embodiment, the roll 72 may include a pre-folded web and the folding operation is not necessary. In another embodiment, a first web from a first roll and a second web from a second roll may be provided and advanced in parallel along the machine direction. The first and second webs may be joined along one edge to form the bottom portion of the bags.

The folded web 92 may be processed in a fragrance application operation 94, as shown in detail in FIG. 7. The fragrance application operation may apply the liquid agent to the interior surface or the exterior surface of the web. As shown in FIG. 6, a draw tape operation 102 can insert a draw tape 104 into the folded web 92. Furthermore, a sealing operation 106 can form the parallel side edges of the finished bag by forming heat seals 108 between adjacent portions of the folded web 92. The sealing operation 106 can space the heat seals 108 along the folded web 92. The sealing operation 106 can form the heat seals 108 using a heating device, such as, a heated knife.

A perforating operation 110 may form perforations 112 in the heat seals 108 using a perforating device, such as, a perforating knife. The perforations 112 in conjunction with the folded outer edge 84 can define individual bags 114 that may be separated from the folded web 92. A roll 116 can wind the folded web 92 embodying the finished bags 114 for packaging and distribution. For example, the roll 116 may be placed into a box or bag for sale to a customer.

In still further implementations, the folded web 92 may be cut into individual bags along the heat seals 108 by a cutting operation. In another implementation, the folded web 92 may be folded one or more times prior to the cutting operation. In yet another implementation, the side sealing operation 106 may be combined with the cutting and/or perforation operations 110.

One will appreciate in light of the disclosure herein that the process 70 described in relation to FIG. 6 can be modified to omit or expanded acts, or vary the order of the various acts as desired.

As shown in FIG. 7, the fragrance application operation 94 comprises putting the folded web 92 through a set of separating rollers 96 with a fluid applicator 98 between the two layers 86, 88 of the folded web 92. The fluid applicator 98 can disperse a fluid 99 such as a liquid additive, a fragrance, a malodor control agent, a fragrance release inhibitor, or a combination thereof on to the interior surfaces of the folded web 92. After fluid application, the two layers 86, 88 are brought together for further processing, such as a drawstring insertion operation 102 shown in FIG. 6. The fluid applicator 98 can be a micro-droplet fluid pressure system that does not use air to propel the fluid 99. In addition, the flow is positively cut off between application cycles so that the fluid 99 can be intermittently and precisely applied to a particular area of the folded web 92 and fluid 99 is not applied to areas that could create problems, such as the seal areas 108. The use of multiple fluid applicators 98 would allow the application of different fluids 99 to different areas of the folded web 92 and, therefore, different areas of the final bag 114. Typical coating or spraying applications are continuous or semi-continuous so that precise application cannot be achieved.

Figure 8:
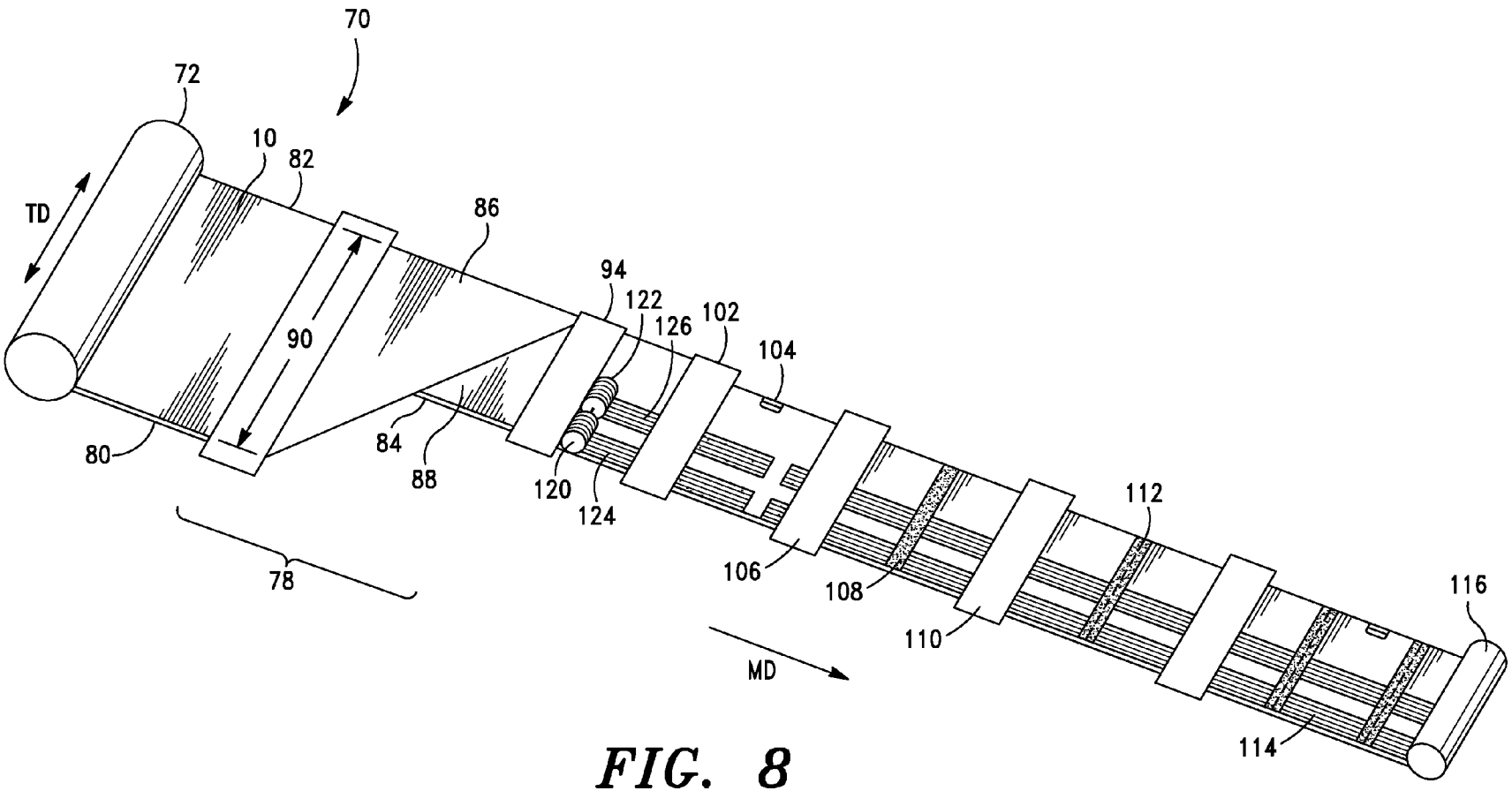
FIG. 8 is a process for producing bags of the invention.

Another high speed, automated manufacturing process is illustrated in FIG. 8. This process is similar to that shown in FIGS. 6 and 7 except rollers 120 and 122 may be used to modify the folded web 92 to impart patterns 124 and 126. The rollers 120 and 122 have opposing rollers on the underside of the folded web 92. The pattern may be formed by embossing, ring rolling, or other means. The application of the fragrance component to the patterned area or area to be later patterns may result in a bag that has different fragrance component transmission properties compared to an area of unpatterned bag.

Figure 9:
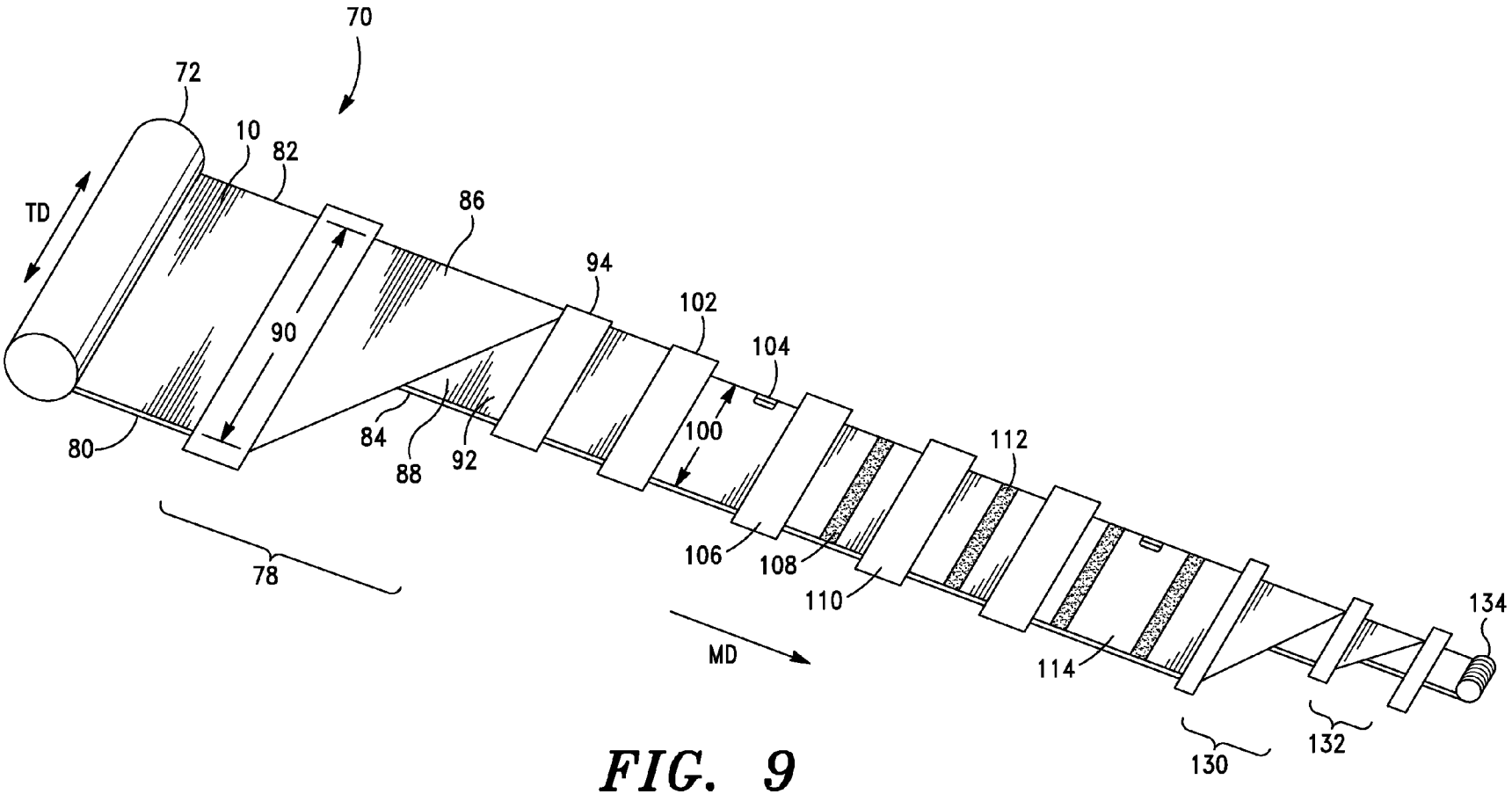
FIG. 9 is a process for producing bags of the invention.

Another high speed, automated manufacturing process is illustrated in FIG. 9. This process is similar to that shown in FIGS. 6 and 7 except that after the sealing and perforating operations of FIG. 6 there are additional folding operations. The sealed and perforated bag is put through a second folding operation 130, similar to folding operation 78, and then a third folding operation 132, also similar to folding operation 78. After the additional folding operations 130, 132, the folded web is put on a roll 134.

Many of the above earlier embodiments may be combined with each other to create further embodiments of the bag. Accordingly, all of the features discussed in the earlier described embodiments may be included in any of the other embodiments disclosed herein, as appropriate.

The bag and bag components may be made of thermoplastic. The materials are suitably hydrophobic polymers not derivatized by actives, such as fragrance components and malodor control agents. Useful materials in the inventive films include but are not limited to thermoplastic polyolefins, including polyethylene and copolymers thereof and polypropylene and copolymers thereof. Suitable polyethylenes include high density polyethylene, medium density polyethylene, low density polyethylene, very low density polyethylene, and linear low density polyethylene.

The olefin based polymers include the most common ethylene or propylene based polymers such as polyethylene, polypropylene, and copolymers such as ethylene vinylacetate (EVA), ethylene methyl acrylate (EMA) and ethylene acrylic acid (EAA), or blends of such polyolefins. Other examples of polymers suitable for use as films include elastomeric polymers. Suitable elastomeric polymers may also be biodegradable or environmentally degradable. Suitable elastomeric polymers for the film include poly(ethylene-butene), poly (ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), ethylene-propylene rubber. This new class of rubber-like polymers may also be employed and they are generally referred to herein as metallocene polymers or polyolefins produced from single-cite catalysts. The most preferred catalysts are known in the art as metallocene catalysts whereby ethylene, propylene, styrene and other olefins may be polymerized with butene, hexene, octene, etc., to provide elastomers suitable for use in accordance with the principles of this invention, such as poly(ethylene-butene), poly(ethylene-hexene), poly(ethylene-octene), poly(ethylene-propylene), and/or polyolefin terpolymers thereof. It can be suitable to blend into the resin a suitable amount of a cling agent, such as polyisobutylene, to control the level of lamination during the lamination process.

Malodors are usually caused by particularly odorous substances which are, however, frequently only present in trace amounts. Such substances include, for example, nitrogen-containing compounds such as ammonia and amines, heterocyclic compounds such as pyridines, pyrazines, indoles, etc. and sulfur-containing compounds such as hydrogen sulfide, mercaptans, sulfides, acidic compounds such as acetic acid, butyric acid and fatty acids, and aldehyde compounds such as acetaldehyde and formaldehyde. The masking of malodors is a problem, which is difficult to handle and solve with perfume compositions. The specific unique quality of a malodor greatly restricts the use of perfumes having the various types of commonly known fragrances. Usually, it is only possible to mask malodors by means of a specially developed perfume oil having a very specific type of fragrance. Active ingredients are, therefore, particularly advantageous when they are capable of reducing the intensity of malodors without themselves possessing any significantly intense odor or fragrance. Such active ingredients do not mask malodors but neutralize them. This has the advantage that when using such active ingredients for perfuming objects or products with malodors, perfume oils of any desired type of fragrance can be used. The consumer can, therefore, be offered a considerably broader range of fragrance types for combating malodors. In addition, active ingredients, which neutralize malodors, provide the possibility of reducing the quantity of perfume oil previously required for masking odors. It is also possible to use less intensely odorous perfumes for combating malodors than those so far employed, which sometimes have an overpowering effect due to their high intensity.

Suitable fragrance ingredients include extracts from natural raw materials such as essential oils, concretes, absolutes, resins, resinoids, balsams, tinctures such as for example ambergris tincture; amyris oil; angelica seed oil; angelica root oil; aniseed oil; valerian oil; basil oil; tree moss absolute; bay oil; armoise oil; benzoe resinoid; bergamot oil; beeswax absolute; birch tar oil; bitter almond oil; savory oil; buchu leaf oil; cabreuva oil; cade oil; calamus oil; camphor oil; cananga oil; cardamom oil; cascarilla oil; cassia oil; cassie absolute; castoreum absolute; cedar leaf oil; cedar wood oil; cistus oil; citronella oil; lemon oil; copaiba balsam; copaiba balsam oil; coriander oil; costus root oil; cumin oil; cypress oil; davana oil; dill weed oil; dill seed oil; eau de brouts absolute; oakmoss absolute; elemi oil; estragon oil; eucalyptus citriodora oil; eucalyptus oil (cineole type); fennel oil; fir needle oil; galbanum oil; galbanum resin; geranium oil; grapefruit oil; guaiacwood oil; gurjun balsam; gurjun balsam oil; helichrysum absolute; helichrysum oil; ginger oil; iris root absolute; iris root oil; jasmine absolute; calamus oil; blue camomile oil; Roman camomile oil; carrot seed oil; cascarilla oil; pine needle oil; spearmint oil; caraway oil; labdanum oil; labdanum absolute; labdanum resin; lavandin absolute; lavandin oil; lavender absolute; lavender oil; lemon-grass oil; lovage oil; lime oil distilled; lime oil expressed; linaloe oil; Litsea cubeba oil; laurel leaf oil; mace oil; marjoram oil; mandarin oil; massoi (bark) oil; mimosa absolute; ambrette seed oil; musk tincture; clary sage oil; nutmeg oil; myrrh absolute; myrrh oil; myrtle oil; clove leaf oil; clove bud oil; neroli oil; olibanum absolute; olibanum oil; opopanax oil; orange flower absolute; orange oil; origanum oil; palmarosa oil; patchouli oil; perilla oil; Peru balsam oil; parsley leaf oil; parsley seed oil; petitgrain oil; peppermint oil; pepper oil; pimento oil; pine oil; pennyroyal oil; rose absolute; rosewood oil; rose oil; rosemary oil; Dalmatian sage oil; Spanish sage oil; sandalwood oil; celery seed oil: spike-lavender oil; star anise oil; storax oil; tagetes oil; fir needle oil; tea tree oil; turpentine oil; thyme oil; Tolu balsam; tonka bean absolute; tuberose absolute; vanilla extract; violet leaf absolute; verbena oil; vetiver oil; juniperberry oil; wine lees oil; wormwood oil; wintergreen oil; ylang-ylang oil; hyssop oil; civet absolute; cinnamon leaf oil; cinnamon bark oil; and fractions thereof or ingredients isolated therefrom; individual fragrance ingredients from the group comprising hydrocarbons, such as for example 3-carene; α-pinene; β-pinene; α-terpinene; γ-terpinene; p-cymene; bisabolene; camphene; caryophyllene; cedrene; farnesene; limonene; longifolene; myrcene; ocimene; valencene; (E,Z)-1,3,5-undecatriene; styrene; diphenylmethane; aliphatic alcohols, such as for example hexanol; octanol; 3-octanol; 2,6-dimethyl-heptanol; 2-methyl-2-heptanol, 2-methyl-2-octanol; (E)-2-hexenol; (E)- and (Z)-3-hexenol; 1-octen-3-ol; a mixture of 3,4,5, 6,6-pentamethyl-¾-hepten-2-ol and 3,5,6,6-tetramethyl-4-methyleneheptan-2-ol; (E,Z)-2,6-nonadienol; 3,7-dimethyl-7-methoxyoctan-2-ol; 9-decenol; 10-undecenol; 4-methyl-3-decen-5-ol; aliphatic aldehydes and their acetals such as for example hexanal; heptanal; octanal; nonanal; decanal; undecanal; dodecanal; tridecanal; 2-methyloctanal; 2-methylnonanal; (E)-2-hexenal; (Z)-4-heptenal; 2,6-dimethyl-5-heptenal; 10-undecenal; (E)-4-decenal; 2-dodecenal; 2,6,10-trimethyl-5,9-undecadienal; heptanal-diethylacetal; 1,1-dimethoxy-2,2,5-trimethyl-4-hexene; citronellyl oxyacetaldehyde; aliphatic ketones and oximes thereof, such as for example 2-heptanone; 2-octanone; 3-octanone; 2-nonanone; 5-methyl-3-heptanone; 5-methyl-3-heptanone oxime; 2,4,4,7-tetramethyl-6-octen-3-one; aliphatic sulfur-containing compounds, such as for example 3-methylthiohexanol; 3-methylthiohexyl acetate; 3-mercaptohexanol; 3-mercaptohexyl acetate; 3-mercapto-hexyl butyrate; 3-acetyltbiohexyl acetate; 1-menthene-8-thiol; aliphatic nitriles, such as for example 2-nonenenitrile; 2-tridecenenitrile; 2,12-tridecenenitrile; 3,7-dimethyl-2,6-octadienenitrile; 3,7-dimethyl-6-octenenitrile; aliphatic carboxylic acids and esters thereof, such as for example (E)-and (Z)-3-hexenylformate; ethyl acetoacetate; isoamyl acetate; hexyl acetate; 3,5,5-trimethylhexyl acetate; 3-methyl-2-butenyl acetate; (E)-2-hexenyl acetate; (E)-and (Z)-3-hexenyl acetate; octyl acetate; 3-octyl acetate; 1-octen-3-yl acetate; ethyl butyrate; butyl butyrate; isoamyl butyrate; hexylbutyrate; (E)-and (Z)-3-hexenyl isobutyrate; hexyl crotonate; ethylisovalerate; ethyl-2-methyl pentanoate; ethyl hexanoate; allyl hexanoate; ethyl heptanoate; allyl heptanoate; ethyl octanoate; ethyl-(E,Z)-2,4-decadienoate; methyl-2-octinate; methyl-2-noninate; allyl-2-isoamyl oxyacetate; methyl-3,7-dimethyl-2,6-octadienoate; acyclic terpene alcohols, such as, for example, citronellol; geraniol; nerol; linalool; lavandulol; nerolidol; farnesol; tetrahydrolinalool; tetrahydrogeraniol; 2,6-dimethyl-7-octen-2-ol; 2,6-dimethyloctan-2-ol; 2-methyl-6-methylene-7-octen-2-ol; 2,6-dimethyl-5,7-octadien-2-ol; 2,6-dimethyl-3,5-octadien-2-ol; 3,7-dimethyl-4,6-octadien-3-ol; 3,7-dimethyl-1,5,7-octatrien-3-ol 2,6-dimethyl-2,5,7-octatrien-1-ol; as well as formates, acetates, propionates, isobutyrates, butyrates, isovalerates, pentanoates, hexanoates, crotonates, tiglinates and 3-methyl-2-butenoates thereof; acyclic terpene aldehydes and ketones, such as, for example, geranial; neral; citronellal; 7-hydroxy-3,7-dimethyloctanal; 7-methoxy-3,7-dimethyloctanal; 2,6,10-trimethyl-9-undecenal; α-sinensal; β-sinensal; geranylacetone; as well as the dimethyl-and diethylacetals of geranial, neral and 7-hydroxy-3,7-dimethyloctanal; cyclic terpene alcohols, such as, for example, menthol; isopulegol; alpha-terpineol; terpinen-4-ol; menthan-8-ol; menthan-1-ol; menthan-7-ol; borneol; isoborneol; linalool oxide; nopol; cedrol; ambrinol; vetiverol; guaiol; and the formates, acetates, propionates, isobutyrates, butyrates, isovalerates, pentanoates, hexanoates, crotonates, tiglinates and 3-methyl-2-butenoates of alpha-terpineol; terpinen-4-ol; methan-8-ol; methan-1-ol; methan-7-ol; borneol; isoborneol; linalool oxide; nopol; cedrol; ambrinol; vetiverol; guaiol; cyclic terpene aldehydes and ketones, such as, for example, menthone; isomenthone; 8-mercaptomenthan-3-one; carvone; camphor; fenchone; alpha-ionone; beta-ionone; alpha-n-methylionone; beta-n-methylionone; alpha-isomethylionone; beta-isomethylionone; alpha-irone; alpha-damascone; beta-damascone; beta-danascenone; delta-damascone; gamma-damascone; 1-(2,4,4-trimethyl-2-cyclohexen-1-yl)-2-buten-1-one; 1,3,4,6,7,8a-hexahydro-1,1,5,5-tetramethyl-2H-2,4a-methanonaphthalen-8(5H)-one; nootkatone; dihydronootkatone; acetylated cedarwood oil (cedryl methyl ketone); cyclic alcohols, such as, for example, 4-tert.-butylcyclohexanol; 3,3,5-trimethylcyclohexanol; 3-isocamphylcyclo-hexanol; 2,6,9-trimethyl-Z2,Z5,E9-cyclododecatrien-1-ol; 2-isobutyl-4-methyltetra-hydro-2H-pyran-4-ol; cycloaliphatic alcohols, such as, for example, alpha,3,3-trimethylcyclo-hexyl-methanol; 2-methyl-4-(2,2,3-trimethyl-3-cyclopent-1-yl)butanol; 2-methyl-4-(2,2,3-trimethyl-3-cyclopent-1-yl)-2-buten-1-ol; 2-ethyl-4-(2,2,3-trimethyl-3-cyclopent-1-yl)-2-buten-1-ol; 3-methyl-5-(2,2, 3-trimethyl-3-cyclopent-1-yl)-pentan-2-ol; 3-methyl-5-(2,2,3-trimethyl-3-cyclopent-1-yl)-4-penten-2-ol; 3,3-dimethyl-5-(2,2,3-trimethyl-3-cyclopent-1-yl)-4-penten-2-ol; 1-(2,2,6-trimethylcyclohexyl)pentan-3-ol; 1-(2,2,6-trimethylcyclohexyl)hexan-3-ol; cyclic and cycloaliphatic ethers, such as, for example, cineole; cedryl methyl ether; cyclododecyl methyl ether; (ethoxymethoxy) cyclododecane; alpha-cedrene epoxide; 3a,6,6,9a-tetramethyl-dodecahydronaphtho[2,1-b]furan; 3a-ethyl-6,6,9a-trimethyl-dodecahydronaphtho[2,1-b]furan; 1,5,9-trimethyl-13-oxabicyclo[10.1.0]-trideca-4,8-diene; rose oxide; 2-(2,4-dimethyl-3-cyclohexen-1-yl)-5-methyl-5-(1-methylpropyl)-1,3-dioxan; cyclic ketones, such as, for example, 4-tert.-butylcyclohexanone; 2,2,5-trimethyl-5-pentylcyclopentanone; 2-heptylcyclopentanone; 2-pentylcyclopentanone; 2-hydroxy-3-methyl-2-cyclopenten-1-one; 3-methyl-cis-2-penten-1-yl-2-cyclopenten-1-one; 3-methyl-2-pentyl-2-cyclopenten-1-one; 3-methyl-4-cyclopentadecenone; 3-methyl-5-cyclopentadecenone; 3-methylcyclopentadecanone; 4-(1-ethoxyvinyl)-3,3,5,5-tetramethylcyclo-hexanone; 4-tert.-pentylcyclohexanone; 5-cyclohexadecen-1-one; 6,7-dihydro-1,1,2,3,3-pentamethyl-4(5H)-indanone; 5-cyclohexadecen-1-one; 8-cyclohexadecen-1-one; 9-cycloheptadecen-1-one; cyclopentadeca-none; cycloaliphatic aldehydes, such as, for example, 2,4-dimethyl-3-cyclohexene carbaldehyde; 2-methyl-4-(2,2,6-trimethyl-cyclohexen-1-yl)-2-butenal; 4-(4-hydroxy-4-methylpentyl)-3-cyclohexene carbaldehyde; 4-(4-methyl-3-penten-1-yl)-3-cyclohexene carbaldehyde; cycloaliphatic ketones, such as, for example, 1-(3,3-dimethylcyclohexyl)-4-penten-1-one; 1-(5,5-dimethyl-1-cyclohexen-1-yl)-4-penten-1-one; 2,3,8,8-tetramethyl-1,2,3,4,5,6,7,8-octahydro-2-naphtalenyl methyl ketone; methyl-2,6,10-trimethyl-2,5,9-cyclododecatrienyl ketone; tert.-butyl-(2,4-dimethyl-3-cyclohexen-1-yl)ketone; esters of cyclic alcohols, such as, for example, 2-tert.-butylcyclohexyl acetate; 4-tert.-butylcyclohexyl acetate; 2-tert.-pentylcyclohexyl acetate; 4-tert.-pentylcyclohexyl acetate; decahydro-2-naphthyl acetate; 3-pentyltetrahydro-2H-pyran-4-yl acetate; decahydro-2,5, 5,8a-tetramethyl-2-naphthyl acetate; 4,7-methano-3a,4,5,6,7,7a-hexa-hydro-5 or 6-indenyl acetate; 4,7-methano-3a,4,5,6,7,7a-hexahydro-5 or 6-indenyl propionate; 4,7-methano-3a,4,5,6,7,7a-hexahydro-5 or 6-indenyl isobutyrate; 4,7-methanooctahydro-5 or 6-indenyl acetate; esters of cycloaliphatic carboxylic acids, such as, for example, allyl 3-cyclohexyl-propionate; allyl cyclohexyl oxyacetate; methyl dihydrojasmo-nate; methyl jasmonate; methyl 2-hexyl-3-oxocyclopentanecarboxylate; ethyl 2-ethyl-6,6-dimethyl-2-cyclohexenecarboxylate; ethyl 2,3,6,6-tetramethyl-2-cyclohexenecar-boxylate; ethyl 2-methyl-1,3-dioxolane-2-acetate; araliphatic alcohols, such as, for example, benzyl alcohol; 1-phenylethyl alcohol; 2-phenylethyl alcohol; 3-phenylpro-panol; 2-phenylpropanol; 2-phenoxyethanol; 2,2-dimethyl-3-phenylpropanol; 2,2-dimethyl-3-(3-methylphenyl)propanol; 1,1-dimethyl-2-phenylethyl alcohol; 1,1-dimethyl-3-phenylpropanol; 1-ethyl-1-methyl-3-phenylpropanol; 2-methyl-5-phenylpentanol; 3-methyl-5-phenylpentanol; 3-phenyl-2-propen-1-ol; 4-methoxybenzyl alcohol; 1-(4-isopropylphenyl)ethanol; esters of araliphatic alcohols and aliphatic carboxylic acids, such as, for example, benzyl acetate; benzyl propionate; benzyl isobutyrate; benzyl isovalerate; 2-phenylethyl acetate; 2-phenylethyl propionate; 2-phenylethyl isobutyrate; 2-phenylethyl isovalerate; 1-phenylethyl acetate; alpha-trichloromethylbenzyl acetate; alpha, alpha-dimethylphenylethyl acetate; alpha,alpha-dimethylphenylethyl butyrate; cinnamyl acetate; 2-phenoxyethyl isobutyrate; 4-methoxybenzyl acetate; araliphatic ethers, such as for example 2-phenylethyl methyl ether; 2-phenylethyl isoamyl ether; 2-phenylethyl-1-ethoxyethyl ether; phenylace-taldehyde dimethyl acetal; phenylacetaldehyde diethyl acetal; hydratropaaldehyde dimethyl acetal; phenylacetaldehyde glycerol acetal; 2, 4,6-trimethyl-4-phenyl-1,3-dioxane; 4,4a,5,9b-tetrahydroindeno[1,2-d]-m-dioxin; 4,4a, 5,9b-tetrahydro-2,4-dimethylindeno[1,2-d]-m-dioxin; aromatic and araliphatic aldehydes, such as, for example, benzaldehyde; phenylacetaldehyde; 3-phenylpropanal; hydratropaldehyde; 4-methylbenzaldehyde; 4-methyl-phenylacetaldehyde; 3-(4-ethylphenyl)-2,2-dimethylpropanal; 2-methyl-3-(4-isopropylphenyl)propanal; 2-methyl-3-(4-tert.-butylphenyl)propanal; 3-(4-tert.-butyl-phenyl)propanal; cinnamaldehyde; alpha-butylcinnamaldehyde; alpha-amylcinnamaldehyde; alpha-hexylcinnamaldehyde; 3-methyl-5-phenylpentanal; 4-methoxybenzaldehyde; 4-hydroxy-3-methoxybenzalde-hyde; 4-hydroxy-3-ethoxybenzaldehyde; 3,4-methylene-dioxybenzaldehyde; 3,4-dimethoxybenzaldehyde; 2-methyl-3-(4-methoxyphenyl) propanal; 2-methyl-3-(4-methylendioxyphenyl)propanal; aromatic and araliphatic ketones, such as, for example, acetophenone; 4-methylacetophenone; 4-methoxyacetophenone; 4-tert.-butyl-2,6-dimethylacetophenone; 4-phenyl-2-butanone; 4-(4-hydroxyphenyl)-2-butanone; 1-(2-naphthalenyl)ethanone; benzophenone; 1,1,2,3,3,6-hexamethyl-5-indanyl methyl ketone; 6-tert.-butyl-1,1-dimethyl-4-indanyl methyl ketone; 1-[2,3-dihydro-1,1,2,6-tetramethyl-3-(1-methyl-ethyl)-1H-5-indenyl]ethanone; 5',6',7',8'-tetrahydro-3',5',5',6',8',8'-hexamethyl-2-acetonaphthone; aromatic and araliphatic carboxylic acids and esters thereof, such as, for example, benzoic acid; phenylacetic acid; methyl benzoate; ethyl benzoate; hexyl benzoate; benzyl benzoate; methyl phenylacetate; ethyl phenylacetate; geranyl phenylacetate; phenylethyl phenylacetate; methyl cinnamate; ethyl cinnamate; benzyl cinnamate; phenylethyl cinnamate; cinnamyl cinnamate; allyl phenoxyacetate; methyl salicylate; isoamyl salicylate; hexyl salicylate; cyclohexyl salicylate; cis-3-hexenyl salicylate; benzyl salicylate; phenylethyl salicylate; methyl 2,4-dihydroxy-3,6-dimethylbenzoate; ethyl 3-phenylglycidate; ethyl 3-methyl-3-phenylglycidate; nitrogen-containing aromatic compounds, such as, for example, 2,4,6-trinitro-1,3-dimethyl-5-tert-butylbenzene; 3,5-dinitro-2,6-dimethyl-4-tert.-butylacetophenone; cinnamonitrile; 5-phenyl-3-methyl-2-pentenonitrile; 5-phenyl-3-methylpentanonitrile; methyl anthranilate; methy-N-methylanthranilate; Schiff's bases of methyl anthranilate with 7-hydroxy-3,7-dimethyloctanal, 2-methyl-3-(4-tert.-butylphenyl)-propanal or 2,4-dimethyl-3-cyclohexene carbaldehyde; 6-isopropylquinoline; 6-isobutylquinoline; 6-sec.-butylquinoline; indole; skatole; 2-methoxy-3-isopropyl-pyrazine; 2-isobutyl-3-methoxypyrazine; phenols, phenyl ethers and phenyl esters, such as, for example, estragole; anethole; eugenol; eugenyl methyl ether; isoeugenol; isoeugenol methyl ether; thymol; carvacrol; diphenyl ether; beta-naphthyl methyl ether; beta-naphthyl ethyl ether; beta-naphthyl isobutyl ether; 1, 4-dimethoxybenzene; eugenyl acetate; 2-methoxy-4-methylphenol; 2-ethoxy-5-(1-propenyl)phenol; p-cresyl phenylacetate; heterocyclic compounds, such as, for example, 2,5-dimethyl-4-hydroxy-2H-furan-3-one; 2-ethyl-4-hydroxy-5-methyl-2H-furan-3-one; 3-hydroxy-2-methyl-4H-pyran-4-one; 2-ethyl-3-hydroxy-4H-pyran-4-one; lactones, such as, for example, 1,4-octanolide; 3-methyl-1, 4-octanolide; 1,4-nonanolide; 1,4-decanolide; 8-decen-1, 4-olide; 1,4-undecanolide; 1,4-dodecanolide; 1,5-decanolide; 1,5-dodecanolide; 1,15-pentadecanolide; cis-and trans-11-pentadecen-1,15-olide; cis-and trans-12-pentadecen-1,15-olide; 1,16-hexadecanolide; 9-hexadecen-1,16-olide; 10-oxa-1,16-hexadecanolide; 11-oxa-1,16-hexadecanolide; 12-oxa-1,16-hexadecanolide; ethylene-1,12-dodecanedioate ; ethylene-1,13-tridecanedioate; coumarin; 2,3-dihydro coumarin; octahydrocoumarin. The fragrance may be added as a liquid additive, a liquid emulsion, or a liquid suspension.

Especially suitable lemon fragrances are limonenal (3-(4-methyl-3-cyclohexenyl)butanal), limonene (4-isopropenyl-1-methylcyclohexene), lemon oil, and lemonal (3,7-dimethyl-2,6-octadienal).

Suitable malodor control agents are the general classification of musk compounds. These include Galaxolide™ (1,3, 4,6,7,8-hexahydro-4,6,6,7,8,8-hexamethylcyclopenta-2-benzopyran), Traseolide™ (6-acetyl-1-isopropyl-2, 3,3,5-tetramethylindane), Ambrettolide (cyclohexadecen-7-olide), Celestolide (4-Acetyl-6-tert-butyl-1,1-dimethylindane), Dihydroambrettolide (cyclohexadecanolide), Ethylene brassylate (cyclo-1,13-ethylenedioxy-tridecan-1,13-dione), Exaltolide (cyclopentadecanolide), Exaltone (cyclopentadecanone), Moskene (1,1,3,3,5-Pentamethyl-4,6-dinitroindane), Musk ambrette (2,4-dinitro-3-methyl-6-tert-butylanisole), Musk Ketone (4-tert-butyl-3,5-dinitro-2,6-dimethylacetophenone), Musk MC4 (ethylene 1,12-dodecanedioate), Musk R1 (11-Oxahexadecanolide), Musk tibetine (2-tert-butyl-1,3-dinitro-4,5,6-trinitrobenzene), Musk xylol (1-tert-butyl-3,5-dimethyl-2,4,6-trinitrobenzene), Phentolide (5-Acetyl-1,1,2,3,3,6-hexamethylindane), Tonalid (1,1,2,4,4,7-hexamethyl-6-acetyl-1,2,3,4-tetrahydronaphthalene), versalide (1,1,4,4-tetramethyl-6-acetyl-7-ethyl-1,2,3,4-tetrahydronaphthalene).

Additional suitable malodor control agents are found in PCT App. WO2009/131748 to Conover, describing a multiple component compound containing a molecular encapsulator, Ordenone, and an aromatic complex, such as citronellal and hydroxycitronella. Additional useful compounds are aldehydes and their complexes, such as aldehydes and complexes of decanal; undecanal; dodecanal; undecene-10-al; 2-methyl-undecanal; 2,3,5,5-tetramethylhexanal; 1-formyl-2,4-dimethyl-2-cyclohexene; 1-formyl-3,5-dimethyl-4-cyclohexene; 1-formyl-2,3,5-trimethyl-4-cyclohexene; 1-formyl-2,4,6-trimethyl-3-cyclohexene; ([5.2.1.0]-tricyclo-8-decylidene)-4-butanal; 2,6,10-trimethyl-9-undecenal; (4-methyl-3-pentenyl)-cyclohexene-3-yl carboxaldehyde; 7-formyl-5-isopropyl-2-methyl-[2.2.2]-bicyclo-2-octene; 2-formyl-8-dimethyl-1,2,3,4,5,6,7,8-octahydronaphthalene; citronellal; campholenic aldehyde; α-methyl-3,4-methylenedioxyhydrocinnamic aldehyde; cyclamen aldehyde; lilial; canthoxal; phenylacetic aldehyde; 3-phenylpropionic aldehyde; hydratropic aldehyde; α-methyl-3,4-methylenedioxyhydrocinnamic aldehyde; 3-phenylpropionic aldehyde; hydratropic aldehyde; alkoxyacetaldehydes; ω-hydroxyaldehydes; myrtenal; perilla aldehyde; substituted 2-furyl carboxaldehydes; cinnamic aldehyde; amylcinnamic aldehyde; hexylcinnamic aldehyde; benzaldehyde; anisic aldehyde; heliotropine; veratric aldehyde; vanillin; isovanillin; and ethylvanillin. Suitable nitriles are described in U.S. Pat. No. 6,180,814 to Giersch and WO2008/026140 to Tranzeat such as 3-phenyl-2-propenenitrile, citronitrile, geranyl nitrile, cytronellyl nitrile, 2-propyl-1-heptanenitrile, dodecanenitrile, 3-(2,3-dimethyl-2(3)-cyclopenten-1-yl)butanenitrile and 3-(2-methyl-3-methylene-1-cyclopentyl)butanenitrile. Additional suitable malodor control agents are found in U.S. Pat. No. 6,432,891 to O'Connor and include cyclohexyl and phenoxy substituted esters, such as 1-cyclohexyl-ethyl-butyrate, 1-cyclohexyl-ethyl-acetate, 1-cyclohexyl-ethanol, 4-isopropyl-cyclohexyl-propionate, phenoxyacetic acid 2-hydroxy-ethyl ester. The malodor control agent may be added as a liquid additive, a liquid emulsion, or a liquid suspension.

The film may include a fragrance release inhibitor in the same or different area as the fragrance and malodor control agents. A typical fragrance release inhibitor is titanium dioxide. Additional fragrance release inhibitors include starch, clays and nanoclays, talc, and microcapsules. The fragrance release inhibitor may be added as a liquid additive, a liquid slurry, or a liquid suspension.

Experimental

Three alternative methods of applying fragrance components were compared. Typically in one standard method, the extrusion process, the fragrance components are incorporated into resin pellets and extruded along with the base resin. In this manner, the fragrance components are dispersed within the bag film. This process also results in a high level of fragrance component loss during the heated extrusion process. In addition, it may be difficult to isolate the fragrance components into a desired area of the bag. In another method, the fragrance components are diluted and then sprayed onto the plastic film. Although the fragrance components can be applied to a generally more specific area of the bag, the fragrance components are still highly volatilized during the process. Using the micro-droplet process of the invention, the fragrance components can be applied to a very specific area of the bag. Table I shows the comparative fragrance loss by each of these three processes.

TABLE I

| Process | Fragrance Loss |
|---|---|
| Micro-droplet process | <5% |
| Dilute Spray process | >20% |
| Extrusion process | >30% |

In addition to resulting in lower fragrance loss on initial application, the micro-droplet process results in greater fragrance delivery during initial bag use as shown in Table II.

| Process | Initial Fragrance burst first hour, ug |
|---|---|
| Micro-droplet process | 5200 |
| Extrusion process | 2000 |

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A method for applying fragrance components to a trash bag comprising the steps of:

providing a folded web having a first and a second opposing, adjacent web halves, each half having interior adjacent surfaces and exterior non-adjacent surfaces, while running the folded web in a high speed manufacturing process:

opening the folded web by separating the first and second halves and inserting one or more micro-droplet applicators between the interior adjacent surfaces of the first and second halves, wherein the micro-droplet applicator does not use air to propel the fluid, using the one or more micro-droplet applicators to apply a liquid fragrance component by an intermittent application of droplets using fluid pressure onto the interior surface of the first half, wherein flow of said droplets is cut off between application cycles, closing the folded web by bringing the interior adjacent surfaces of the first and second halves together, providing heat seals to seal the interior surface of the first half of the web to the interior surface of the second half of the web, providing a separating means along the heat seals, and rolling the folded web into a roll.

2. The method of claim 1, further comprising imparting one or more pattern areas to the web.

3. The method of claim 2, wherein imparting one or more pattern areas to the web comprises imparting a pattern area to a folded section of web.

4. The method of claim 2, wherein using the one or more micro-droplet applicators to apply a liquid fragrance component by an intermittent application of droplets using fluid pressure onto the interior surface of the first half comprises applying the fragrance component to a patterned area of the web.

5. The method of claim 1, further comprising providing an additional fold to the web after application of the fragrance component.

6. The method of claim 1, wherein the fragrance component is not applied to the heat seals.

7. The method of claim 1, wherein the fragrance component comprises a component selected from the group consisting of fragrances, fragrance release inhibitors, and malodor control agents, and mixtures thereof.

8. The method of claim 7, wherein a fragrance is applied to a top area of the bag.

9. The method of claim 8, wherein a malodor control agent is applied to an area of the bag below the area where the fragrance is applied.

10. The method of claim 1, wherein a drawstring is attached to the web.

11. The method of claim 1, wherein the separating means is a line of perforation.

12. A method for applying a liquid additive to a trash bag comprising the steps of:

providing a folded web having a first and a second opposing, adjacent webs halves, each half having an interior surface and an exterior surface, while running the folded web in a high speed manufacturing process:

opening the folded web by separating the first and second halves and inserting one or more micro-droplet applicators adjacent to the interior surface of the first and second halves, wherein the micro-droplet applicator does not use air to propel the fluid, using the one or more micro-droplet applicators to apply an intermittent application of droplets of a liquid additive onto the interior surface of the first half, wherein:

a flow of said droplets is cut off between application cycles, and the liquid additive comprises a fragrance, a malodor control agent, a fragrance release inhibitor, or a combination thereof, closing the folded web by bringing the interior surfaces of the first and second halves together, providing heat seals to seal the interior surface of the first half of the web to the interior surface of the second half of the web, and providing a separating means along the heat seals.

13. The method of claim 12, further comprising separating the folded web along the separating means to form individual trash bags.

14. The method of claim 12, further comprising rolling the folded web into a roll of trash bags.

15. The method of claim 12, wherein using the one or more micro-droplet applicators to apply an intermittent application of droplets of the liquid additive onto the interior surface of the first half of the folded web comprises applying the liquid additive onto areas of the interior surface corresponding to a hem area, a draw tape area, or a bottom fold.

16. The method of claim 12, wherein using the one or more micro-droplet applicators to apply an intermittent application of droplets of the liquid additive onto the interior surface of the first half of the folded web comprises applying the liquid additive onto one or more flaps.

17. The method of claim 12, wherein using the one or more micro-droplet applicators to apply an intermittent application of droplets of the liquid additive onto the interior surface of the first half of the folded web comprises applying the liquid additive onto specific areas of the interior surface of the first half while simultaneously not applying any liquid additive onto other areas of the interior surface of the first half.

18. The method of claim 1, wherein using the one or more micro-droplet applicators to apply a liquid fragrance component by an intermittent application of droplets using fluid pressure onto the interior surface of the first half of the folded web comprises applying the liquid additive onto areas of the interior surface corresponding to a hem area, a draw tape area, or a bottom fold.

19. The method of claim 1, wherein using the one or more micro-droplet applicators to apply a liquid fragrance component by an intermittent application of droplets using fluid pressure onto the interior surface of the first half of the folded web comprises applying the liquid additive onto one or more flaps.

20. The method of claim 1, wherein using the one or more micro-droplet applicators to apply a liquid fragrance component by an intermittent application of droplets using fluid pressure onto the interior surface of the first half of the folded web comprises applying the liquid additive onto specific areas of the interior surface of the first half while simultaneously not applying any liquid additive onto other areas of the interior surface of the first half.

* * * * *